United States Patent [19]

Allen

[11] Patent Number: 4,642,815

[45] Date of Patent: Feb. 17, 1987

[54] ADJUSTABLE GUN PAD FOR A SHOOTING GARMENT

[76] Inventor: Robert E. Allen, 3105 Stanton Ave., Des Moines, Iowa 50321

[21] Appl. No.: 824,792

[22] Filed: Jan. 31, 1986

[51] Int. Cl.[4] ..... A41D 13/00

[52] U.S. Cl. ..... 2/2; 2/94; 2/267; 2/DIG. 6

[58] Field of Search ..... 2/2, 94, 267, DIG. 6, 2/2.5

[56] References Cited

U.S. PATENT DOCUMENTS

| | | | |
|---|---|---|---|
| 2,948,898 | 8/1960 | Allen | 2/94 |
| 2,948,899 | 8/1960 | Allen | 2/94 |
| 3,105,241 | 10/1963 | Allen | 2/94 |
| 3,257,666 | 6/1966 | Hoffman | 2/267 X |
| 3,354,470 | 11/1967 | Allen | 2/94 |
| 4,243,165 | 1/1981 | Schuler | 2/94 X |
| 4,455,684 | 6/1984 | Johnson | 2/2 |
| 4,472,839 | 9/1984 | Johansen | 2/DIG. 6 |
| 4,497,069 | 2/1985 | Braunhut | 2/2.5 |

*Primary Examiner*—Louis K. Rimrodt

*Attorney, Agent, or Firm*—Henderson & Sturm

[57] ABSTRACT

A shooting garment having an adjustable shock absorbing pad therefore which can be adjusted vertically on a front shoulder portion of the garment for reducing the recoil shock of a gun which is shot when the butt of the gun is against the pad. Since one shooter may place the butt of a gun at a different position on his shoulder than another, an adjustable pad can be utilized to place the pad precisely at the desired position for each individual shooter. VELCRO fasteners are provided to securely hold the pad in place when in use and also permit the pad to be readily disengaged, moved and repositioned securely in place.

3 Claims, 5 Drawing Figures

ADJUSTABLE GUN PAD FOR A SHOOTING GARMENT

TECHNICAL FIELD

The present invention relates generally to shooting garments, and more particularly to an adjustable shock absorbing pad in combination with a shooting garment.

BACKGROUND ART

Hunting coats having a thick shoulder pad on the front thereof where the butt of a gun would contact the shoulder when shot are well known.

One problem with these types of shooting garments is that different individuals place the butt of their guns at different places on their shoulder and sometimes this does not correspond to the padded portion of the garment. One solution to this problem is to make such pads larger in order for them to be universally useful, but this adds to the cost of the garment and detracts from the aesthetic appearance of such garment. At times when the garment is worn and the wearer does not choose to shoot a shotgun or rifle, the pad may unduly restrict movement of the user.

Consequently, there is a need for a pad structure for a shooting garment which will overcome the aforementioned deficiencies of prior art shooting garments.

DISCLOSURE OF THE INVENTION

The present invention relates to a shooting garment having an adjustable shock absorbing pad therefor which can be adjusted vertically on a front shoulder portion of the garment for reducing the recoil shock of a gun which is shot when the butt of the gun is against the pad. Since one shooter may place the butt of a gun at a different position on his shoulder than another, an adjustable pad can be utilized to place the pad precisely at the desired position for each individual shooter. VELCRO fasteners are provided to securely hold the pad in place when in use and also permit the pad to be readily disengaged, moved and repositioned securely in place.

An object of the present invention is to provide an improved hunting or shooting garment.

Another object of the present invention is to provide an adjustable shock absorbing shoulder pad for a hunting or shooting garment.

A further object of the present invention is to provide a VELCRO attaching structure for an adjustable pad which is economical to produce, and dependable in its construction.

A still further object of the present invention is to provide an adjustable pad having an interior pocket for adding more padding when desired.

Other objects, advantages, and novel features of the present invention will be apparent from the following detailed description of the invention, particularly when viewed in conjunction with the accompanying drawings.

BEST MODE FOR CARRYING OUT THE INVENTION

Figure 1:
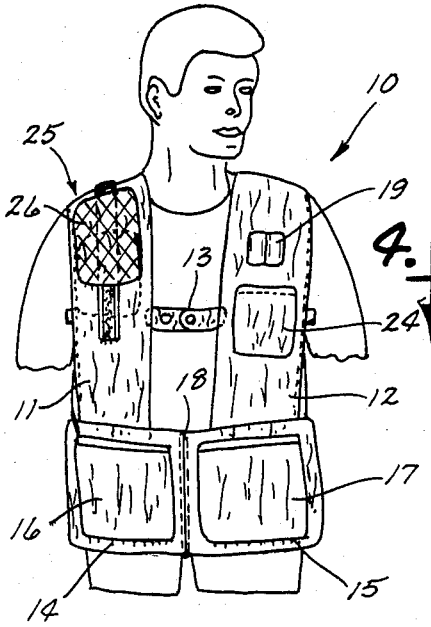
FIG. 1 is a front elevational view of a hunting garment constructed in accordance with the present invention.

Referring now to the drawings, wherein like reference numerals designate identical or corresponding parts throughout the several views, FIG. 1 shows a garment (10) constructed primarily of cloth being worn by a person. The garment (10) has strips of cloth (11 and 12) extending over the shoulders of the person and a fastening structure (13) in the front for holding the strips of cloth (11 and 12) together. A zippered bottom portion (14 and 15) have pockets (16 and 17) thereon and can be zippered together by a zipper (18) centrally disposed between the members (14 and 15) as shown in FIG. 1. Pockets (24) and shotgun shell holding elastic members (19) can be utilized if desired.

A first VELCRO strip (20) is sewn at each end thereof to the garment portion (11) in the position shown in FIG. 1. The stitches (21 and 22) are shown clearly in FIGS. 2 and 3. The center portion of the VELCRO strip (20) is now sewn to the garment portion (11) for reasons which will be explained below.

Figure 3:
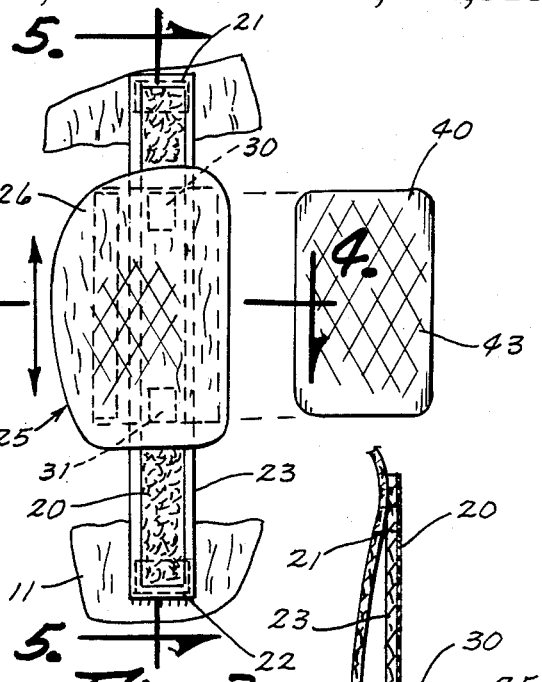
FIG. 3 is a view like FIG. 2, but showing the adjustable pad connected to a VELCRO strip sewn on the garment of FIG. 1 and also showing an auxiliary pad which can be placed into the interior of the adjustable pad when added shock absorbing cushioning is desired.
Figure 2:
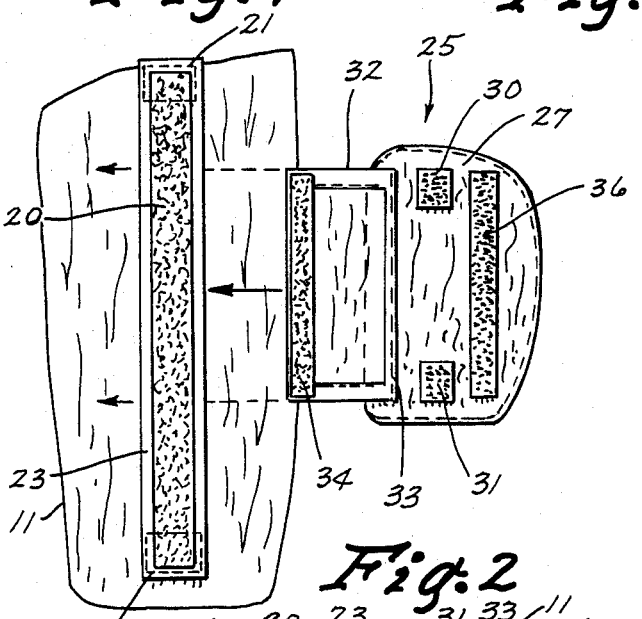
FIG. 2 is an enlarged partial front elevational view showing the adjustable pad structure with VELCRO fasteners thereon on the garment shown in FIG. 1.
Figure 4:
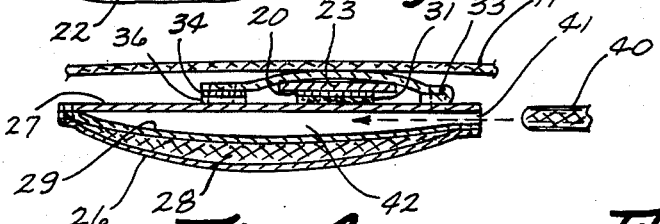
FIG. 4 is a cross sectional view taken along line 4—4 of FIG. 3.
Figure 5:
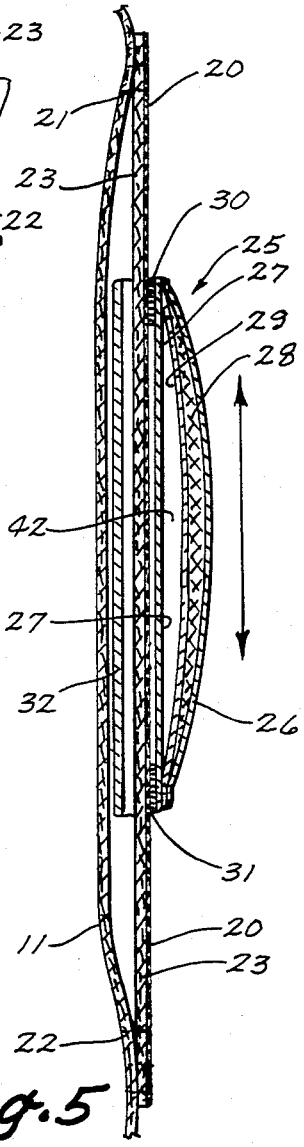
FIG. 5 is an enlarged cross sectional view taken along line 5—5 of FIG. 3.

An adjustable pad (25) includes a front portion (26) as shown in FIGS. 1 and 3, and a rear portion (27) as shown in FIGS. 2, 4 and 5. The front portion (26) includes padding (28), for example foam and a rear wall of the front portion (29) for confining the foam (28). Preferably, there are seams extending across and between the layers (26, 28 and 29) to securely hold the foam (28) in place, although this is strictly optional.

Referring to FIG. 4, it is noted that the VELCRO (20) is sewn to a cloth backing member (23) and that the entire end of VELCRO (20) and backing member (23) are sewn to the cloth panel (11) by the stitches (22).

The pad (25) has a second VELCRO portion (30 and 31) sewn to the back portion (27) thereof for selective connection to the VELCRO portion (20) as will be explained below. A flap (32) is sewn by stitches (33) at one edge thereof to the back (27) of the pad (25). A third VELCRO strip (34) is sewn to the other free edge of the flap (32) as can best be seen in FIG. 2. A fourth VELCRO strip (36) is sewn to the back of the pad (25) on the rear panel (27) for selective engagement with the VELCRO strip (34).

In operation of the present invention, the flap (32) would be positioned as shown in FIG. 2 and the flap (32) would be placed under the intermediate portion of the VELCRO strip (20) and backing strip (23) as indicated by the arrows pointing to the left in FIG. 2. After the flap (32) is so positioned under the backing strip (23), then the pad is adjusted vertically with respect to the VELCRO (20) to be in the proper vertical position, for example as shown in solid lines in FIG. 1, or perhaps if desired in the position shown in dashed lines in FIG. 1. Then, the pad (25) is flipped over on top of the flap (32) to the position shown in FIGS. 3, 4 and 5 such that the VELCRO portions (30 and 31) will contact the VELCRO portion (20) and engage it tightly, while at the same time the VELCRO strips (34 and 36) will engage each other to securely hold the pad (25) in place.

Referring to FIGS. 3 and 4, it is noted that an auxiliary pad (40) constructed of basically the same material as layers (26, 28 and 29) shown in FIG. 4, can be inserted through an opening (41) in one side of the pad (25). The three other sides of the pad (25) have the front layer (26) and back layer (27) sewn together, and it is only the inside portion corresponding to opening (41) which is not sewn together. Consequently the pad (40) will be securely held in place by friction within an opening (42) between the back layer (27) and the layer (29) of the pad (25). The auxiliary pad (40) can also be cross stitched by stitches (43) extending completely through all three layers, if desired.

It can readily be appreciated that once the pad is in one position, for example as shown in solid lines in FIG. 1, the reverse procedure can be used to move the pad (25) to another position, such as the lowered position as shown in dashed lines in FIG. 1, by merely unfastening the VELCRO portions (20, 30, 31) and VELCRO portions (34 and 36) and sliding the pad (25) to such desired and changed position, and then refastening the aforementioned VELCRO fasteners precisely in the fashion referred to above in the original positioning of the pad (25).

Obviously, many modifications and variations of the present invention are possible in light of the above teachings. It is therefore to be understood, that within the scope of the appended claims, the invention may be practised otherwise than as specifically described.

I claim:

1. A shooting garment comprising:

coat means for extending over a wearer's shoulders and having a front portion and a rear portion;

a first VELCRO means anchored at each end thereof to said front portion of said coat means for overlying one shoulder of the wearer, said first velcro means being substantially vertically disposed when said coat means in being worn;

pad means for cushioning the recoil shock from a gun in use when placed against said pad means;

second VELCRO means operably attached to said pad means for selective engagement with said first VELCRO means, said first VELCRO means being substantially vertically longer than said second VELCRO means whereby said pad means can be adjusted vertically by placing the second VELCRO means at different places on said first VELCRO means; and further wherein an intermediate portion of said first VELCRO means intermediate the ends thereof is not attached to the front portion of the coat means thereunder, and said pad means further comprises:

flap means attached along one edge thereof to the back of said pad means and having third VELCRO means attached to the opposite free edge thereof; and fourth VELCRO means attached to the back of said pad means for selective engagement with said third VELCRO means whereby said flap means can be extended between said intermediate portion of the first VELCRO means and the front portion of said coat means when said third and fourth VELCRO means are disengaged with respect to each other and reconnected once the second VELCRO means is connected at the desired location to said first VELCRO means.

2. The shooting garment of claim 1 wherein said second VELCRO means is located on the back of said pad means between said fourth VELCRO means and said one edge of the flap means which is attached to the back of the pad means.

3. The shooting garment of claim 2 including an auxiliary pad wherein said pad means includes means for selectively receivably holding said auxiliary pad between the front and back portions of said pad means whereby said auxiliary pad will provide additional cushioning of the shock of shooting a gun in abutment with said pad means.

* * * * *